US007086827B2

(12) United States Patent
Mokler

(10) Patent No.: US 7,086,827 B2
(45) Date of Patent: Aug. 8, 2006

(54) TURBO MOLECULAR HIGH-VACUUM PUMP WITH A CIRCULAR INTAKE AREA

(75) Inventor: Paul Mokler, Darmstadt (DE)

(73) Assignee: Gesellschaft für Schwerionenforschung mbH, Darmstadt (DE)

( * ) Notice: Subject to any disclaimer, the term of this patent is extended or adjusted under 35 U.S.C. 154(b) by 139 days.

(21) Appl. No.: 10/938,698

(22) Filed: Sep. 11, 2004

(65) Prior Publication Data

US 2005/0106005 A1 May 19, 2005

Related U.S. Application Data

(63) Continuation-in-part of application No. PCT/EP03/01938, filed on Mar. 14, 2003.

(30) Foreign Application Priority Data

Mar. 14, 2002 (DE) ..... 102 11 134

(51) Int. Cl.
*F01D 1/36* (2006.01)
*F03B 5/00* (2006.01)
*F04D 19/04* (2006.01)

(52) U.S. Cl. ..... 415/90; 415/102; 415/103; 417/423.4

(58) Field of Classification Search ..... 415/90, 415/77, 93, 97, 99, 100, 101, 102, 103; 417/423.4
See application file for complete search history.

(56) References Cited

U.S. PATENT DOCUMENTS 3,020,102 A * 2/1962 Becker et al. ..... 415/90
6,364,604 B1 * 4/2002 Nonaka et al. ..... 415/90

* cited by examiner

*Primary Examiner*—Edward K. Look
*Assistant Examiner*—Richard A. Edgar
(74) *Attorney, Agent, or Firm*—Klaus J. Bach

(57) ABSTRACT

In a turbo-molecular pump with a high vacuum-side induction area and of a rotational symmetrical arrangement, comprising a compressor turbine including a rotor and a stator tube having axially alternately tightly arranged rotor blade rings and stator vane rings with oppositely oriented blade and vane surfaces, a pre-vacuum chamber with a gas guide structure for the connection of a pre-pumping system, a drive module and a bearing unit, the turbo-molecular pump has a center area with a central coaxial open space extending from an ambient end to the high vacuum-side induction area and the open space is closed at its end adjacent the ambient end thereof by a flange in a vacuum-tight manner or is connected to a vacuum recipient, and the high-vacuum end of this space is separated from a pre-vacuum space.

20 Claims, 6 Drawing Sheets

TURBO MOLECULAR HIGH-VACUUM PUMP WITH A CIRCULAR INTAKE AREA

This is a Continuation-In-Part Application of international application PCT/EP03/01938 filed Mar. 14, 2003 and claiming the priority of German application 102 11 134.0 filed Mar. 14, 2002.

BACKGROUND OF THE INVENTION

The invention resides in a turbomolecular high vacuum pump with a circular intake area and in turbo-molecular pump groups formed by such pumps.

A turbo-molecular pump typically is of a rotational symmetrical design and includes typically the following sections: A compressor turbine, a pre-vacuum chamber and a drive module as well as a bearing unit. The compressor turbine includes chambers in each of which the same number of rotor and stator blade rings are arranged alternately closely adjacent to one another, wherein generally in each turbine chamber the blade or vane sets begin at the high vacuum end, that is the annular induction area, with a set of rotor blades. The rotor and stator blades or vanes are arranged inclined with respect to the direction of rotation and oriented oppositely so that during operation the gas particles are driven from the high vacuum toward the pre-vacuum area.

In vacuum processing turbo-molecular pumps are the most commonly used pumps for generating low pressures from ultra high vacuum to fine vacuum. Turbomolecular pumps with an annular induction area for the downstream turbine chamber may also be called single-flow passage turbo-molecular pumps. The drive arrangement and the main bearing structure are generally arranged in the pre-vacuum area, wherein, particularly the bearing unit—with a center of gravity-adjusted support of the rotor—extends into the interior of the rotor.

The active pumping area is the annular area at the induction opening as determined by the geometry of the turbine. There is always a pump-inactive, a so-called pumping-blind, circular area in the center. It is however particularly disadvantageous that, at the location of the turbomolecular pump itself, the recipient is not accessible for any purpose except the pumping. If a flange at the recipient is to be used for purposes other than pumping generally branched auxiliary structures such as T- or cross-pieces are mounted in between whereby the pumping effects directly at the recipient are drastically reduced (typically by at least 30%).

Because of the different circumferential speeds of the turbine blades at smaller and greater distances from the centers thereof ($r_{inner}$ and $r_{outer}$) the pumping active annular area of the turbine is limited to certain radii ratios ($r_{inner}/r_{outer}$) which are known in the turbo-molecular pump technology.

For many applications, it would be advantageous if the central area around the turbine axis of a turbomolecular pump would be freely accessible also during operation, or if the recipient, extending at least partially around the turbomolecular pump, would be accessible in this area and/or if the pumping-active annular area could be differentially increased or a concentrically differential pumping would be possible.

With the description of what is impossible to achieve with the conventional turbomolecular pumps or what can be achieved only in a technically complicated way, the object of the invention is determined, that is to provide for the missing possibilities and to avoid technically complicated and disadvantageous designs.

SUMMARY OF THE INVENTION

Basic Principle of an Open Center Area.

In a turbo-molecular pump with a high vacuum-side induction area and of a rotational symmetrical arrangement, comprising a compressor turbine including a rotor and a stator tube having axially alternately tightly arranged rotor blade rings and stator vane rings with oppositely oriented blade and vane surfaces, a pre-vacuum chamber with a gas guide structure for the connection of a pre-pumping system, a drive module and a bearing unit, the turbo-molecular pump has a center area with a central coaxial open space extending from an ambient end to the high vacuum-side induction area and the open space is closed at its end adjacent the ambient end thereof by a flange in a vacuum-tight manner or is connected to a vacuum recipient, and the high-vacuum end of this space is separated from a pre-vacuum space.

With the arrangement according to the invention the turbo-molecular pump has a center area which is fully accessible, that is, this is a coaxially area which is open from the high vacuum side up to the ambient side. This area may be hollow cylindrical with constant, a variable, or with a monotonously changing opening cross-section.

For maintaining different pressure areas however this passage area can on one hand be closed in a gas-tight manner at its front at the ambient at a flange surrounding the central opening hermetically. The closure may be such that spectrally at least parts thereof are permeable to electromagnetic or particle radiation. The closure may also include vacuum tight electrical or mechanical penetrations by way of which apparatus or objects disposed in the high vacuum can be handled from the outside. On the other hand, the turbomolecular pump may be connected there to a part of a recipient or to a high vacuum pump or directly to another suitable pumping device. Particularly, the turbo-molecular pump itself may represent a tubular part of a vacuum apparatus.

However, principally, the high vacuum side front/opening of the central area must be kept separate from the pre-vacuum chamber in a vacuum technically active or passive manner. To this end, different technical measures are employed which will be described in greater detail below:

The rotor, the drive module and the bearing unit have from the high-vacuum area over the pre-vacuum area up to the ambient pressure area a central co-axial open cross-section which is constant or variable over the length thereof.

At the ambient-side front end of the stator housing, that is the base of the turbomolecular pump, an inner co-axial stator tube is connected in a gas-tight manner which extends up to the level of the high-vacuum front end of the rotor. Over its length, it forms the wall of the central co-axial open area, that is, the open passage from the high vacuum side up to the ambient side. The high vacuum end toward the ambient may be provided at any location, particularly however at one end of the inner stator tube or the base plate.

With this arrangement, it is expedient to arrange the drive module and the bearing for the rotor either on a separate annular saddle, the ring saddle, which is disposed on the base plate of the turbomolecular pump or on a ring saddle mounted on the central stator tube, or, possibly also on the outer stator housing or on a support ring or support rings or a combination of these components. The annular saddle design provides for a large free space for a center of gravity and moment of inertia-correct support, that is, the rotating mass is supported in a plane normal to the axis of rotation which axis extends through the center of gravity of the whole rotor or at opposite sides thereof. The bearing may be mechanical or a contact free magnetic bearing.

It is important in this connection that the gas is guided all around between the high vacuum side to the pre-vacuum chamber also from the area between the inner stator tube and the surrounding rotor tube. A backflow from the pre-vacuum chamber must be prevented or at least be held within tolerable limits. This can be done if necessary if the drive module and the bearing for the rotor are provided with pump channels evenly distributed over the circumference and extending from one side to the other. It would also be possible to conduct the gas separately into the pre-vacuum area, see below.

Single Flow Passage Ring-TP, Mono-Ring-TP

In a so-called single flow path turbo-molecular pump, that is, a mono-ring-TP, the hollow rotor and the co-axial inner stator tube coaxially disposed therein form a co-axial annular space. The outer side of the stator tube is disposed opposite the inner side of the hollow rotor so as to form an annular chamber therebetween. At least the rotating side of these two sides, or both, have a surface structure which, together with the shape of the annular space, counteracts a gas back flow from the pre-vacuum side to the high vacuum side or reduces such back-flow to a tolerable rate or even cause a gas flow from the high vacuum side toward the pre-vacuum side and, consequently, have a pumping effect. Preferably, to this end, the coaxial intermediate space is reduced at least in sections to a narrow annular gap, which limits the gas conduction value.

In a further advantageous embodiment, the co-axial intermediate space is coupled by pumping channels which are evenly distributed over the circumference at one or several locations in the intermediate space of the compressor turbine to the vacuum conditions existing in the outer area of the rotor tube, that is, at least at the end of the pre-vacuum area and/or in the intermediate area of the compressor turbine. This can be further enhanced by perforations which are provided in sections of the hollow cylindrical rotor or over the full length, evenly distributed over the circumference, forming pumping passages to the turbine space. As a result, an active pumping action may occurs around the intermediate space in a differential way over the compression range of the turbine in axial direction.

As far as possible, with regard to the space requirements, the opposite walls which define the annular space and which move relative to each other are scale-like structured such that impulses are transmitted to the gas particles directing them toward the vacuum side. This increases the pumping effect in the annular space between the rotor and the inner stator tube. The structuring is therefore designated as a micro-turbine. The scales may be in the form of short blades. In another possible modification, the opposite wall surfaces are provided in the co-axial intermediate space with co-axial helical grooves or projections which are wound thread-like around the axis of rotation of the respective cylindrical surface so that the molecules disposed in the intermediate space are driven preferably toward the pre-vacuum. Such a structure is known in the vacuum field as Holweck stage.

Also, combinations of the measures referred to above could be used to connect the annular space between the inner stator tube and the hollow rotor tube vacuum technically in an optimal way to the rest of the pump, the so-called hybrid gap pump. The turbomolecular pump may also be modified with a single passage outer compression chamber whose rotor vanes extend radially outwardly. In addition, there is an inner annular gap of small width between the inner stator tube and the surrounding rotor. In principle, also a single passage turbomolecular pump with a radially mirror-reversed arrangement, that is, with an inner compression chamber and an outer annular gap may be used.

Two-Passage Ring-TP, Duo-Ring PT

Below the two passage turbomolecular pump, that is, the duo-ring PT will be described:

Basically, a two-passage turbomolecular pump is a twin turbine mechanically coupled by the rotor with a concentric arrangement of an outer and an inner compression chamber and consequently an outer and an inner annular induction area. The blades of the inner compressor chamber however are oriented radially opposite to the corresponding blades of the outer compression chamber.

The rotor blades in the outer compression chamber have during rotation a self-stabilizing orientation in which they extend radially outwardly. They are sufficiently anchored at their foot ends. A position deviating from the radial orientation would generate during rotation a backward force. Not however in connection with the rotor blades of the inner compression chamber; They have only a radially inwardly directed stable orientation. Any non-radial sideward deviation of the radial orientation increases that tendency during rotation. For safety reasons, it may therefore be appropriate to provide a stabilization ring interconnecting the radially inwardly directed ends of the rotor blades of the inner compression chamber.

With this arrangement, two concentric intake areas are provided which are disposed in a single plane and surround the opening of the central open passage of the turbo molecular pump. Generally, the suction effect in the respective intake areas is different. The geometry of the compression chambers and the blades can be so selected that different pumping effects can be obtained but also so that both compression chambers provide for the same suction effect.

Both turbine parts may also act toward separate pre-vacuum chambers which are also separately pumped out, so that a differential pumping can be selectively obtained.

Additional Equipment

For may vacuum-engineering applications a controlled differential pumping or eventually also the formation of a gas beam/-jet is important. To this end, a gas guide sheet is arranged at the high vacuum front end of the outer stator tube and/or the rotor tube and/or the inner stator tube which guide sheet in each case is provided with central skimmer nozzles disposed along the rotor axis.

In a single passage turbo-molecular pump, it may be expedient to provide at the high vacuum end of the inner stator tube a short gas guide baffle which extends radially outwardly and which then displaces the annular opening between the inner stator and the rotor toward the induction opening. In this way, a possible slight gas back flow from this annular gap area would be directly and differentially sucked away.

For the evacuation of a recipient after ventilation or a corresponding central gas generation or suddenly occurring large leakages at the recipient in an emergency situation, the use of a manual or better a pressure-controlled valve is advantageous which couples the three areas high-vacuum, pre-vacuum, ambient. If such a valve is connected near the ambient end face of the inner stator tube to the pre-vacuum chamber area by way of one or several passages, the gas flow can be controlled as to its direction by a valve installed at that location. For example, with a mechanical pressure controlled valve after ventilation, the ambient pressure still present in the recipient can move the valve into a position which provides for direct communication between the inner stator tube and the pre-vacuum chamber. When the pressure in the pre-vacuum chamber drops below a certain threshold, the valve moves into a position in which the passages in the stator tube to the pre-vacuum chamber and consequently the direct connection to the vacuum pump is closed. In an emergency situation, in which the gas pressure in the recipient would again rise above the threshold value, the valve would again be returned to a position, providing direct communication with the pre-vacuum chamber, particularly with a sudden pressure increase. A manual or an electronic control of the bypass valve integrated into the turbomolecular valve may be useful. In principle however, with high gas flows from the center, the central area may be permanently connected to the pre-vacuum area.

Multi-Ring TP-System

From the two principal designs for ring turbo molecular pumps, the single flow passage and the double flow passage, group arrangements can be provided, including multi-ring TP systems, in one or in mixed arrangements. One arrangement is particularly suitable for differential pumping that is an arrangement wherein the concentric structure comprises at least two turbomolecular pumps. They have different sizes, different outer diameters and different diameters of the inner central areas. The geometrically smaller pump is arranged in the central open area of the larger pump. Herein, at least in the high-vacuum end area, the outer stator the smaller pump abuts the inner stator tube in a gas-tight manner or it is firmly mechanically coupled in a gas-tight manner by a ring or, with a fully integrated system a common intermediate stator wall is provided. Form the basis ring, turbo molecular pumps or from such concentric arrangements various pumping setups can be provided for a recipient.

In a simple arrangement, the turbomolecular pump is directly flanged to a wall of a recipient and the central open area is used for other purposes and closed in a vacuum-tight manner. In another arrangement, the pump interconnects two recipient areas wherein one is connected to the high vacuum end and the other to the inner stator tube or to the base plate—that is, also to the high vacuum.

More Complex Arrangements are as Follows:

The elementary pumps, with single or double inlet flow passage, are arranged coaxially, one after the other, oriented in the same way or in opposition, such that also differential pumping is possible. In such complex systems, the axes may also be arranged cross-wise, for example, a sharply bundled gas beam, a jet consisting of neutral atoms crosses an ion beam.

Double Faced Tube—TP

In a very special but still simple arrangement two elementary, purely single flow passage pumps with adjacent pre-vacuum areas are disposed on a common axis so as to be oppositely oriented. Such an arrangement is called the double faced tube—TP. This pump is also constructed rotation symmetrically and also includes the sections typical for this type: Annular induction areas, compressor turbines, pre-vacuum chamber with gas guide structure for the connection of a pre-pump system, a drive module and a bearing unit. However, the setup is as follows: the stator surrounds the rotor over the full length thereof. The rotor has a central co-axial open area extending fully through the rotor. Inserted into the rotor axially toward the center are rotor vane or blade rings which, with the correspondingly arranged stator vane rings form two compressor chambers with the common a separate two pre-vacuum chambers disposed therebetween. At the two opposite ends of the rotor—stator arrangement the annular induction area surrounds the respective entrance to the co-axial open area. The drive module is arranged between the stator and the rotor in the pre-vacuum chamber. The bearing unit is integrated into the drive unit or is disposed adjacent thereto at the left and right axial ends thereof. The gas guide structure to the pre-pumping system is connected therein at the circumference thereof.

In the double-face arrangement with, in each case, a single-passage turbine structure no internal stator tube is needed for technical or functional reasons. (However, if two double flow passage elementary turbo-molecular pumps would be combined correspondingly an inner stator tube would be required). The integral design is particularly suitable for the installation and partial enclosure of tubular vacuum systems and for axially differential pumping.

In accelerators, high energy particle beams are guided in tubes, beam tubes, accelerator tubes etc. in a high vacuum. If these highly intense beams or parts thereof reach directly the chamber wall of the recipient, the wall is highly heated and this leads among others by desorption and degasification locally to the generation of a large amount of gas with the result of a possible collapse of the necessary vacuum. By means of a diverter arranged on the inside of the stator tube of the double faced single passage tube pump the beam losses can be geometrically localized and, with the fast rotation, the particle energy disposed therein is at least partially distributed circumferentially so that the local heating is reduced resulting in the generation of lower amounts of gas which can be pumped out directly.

Examples

The advantages of the single and double passage annular turbo molecular pumps will be described below in greater detail on the basis of the accompanying drawings.

DESCRIPTION OF THE VARIOUS ARRANGEMENTS

Figure 1:
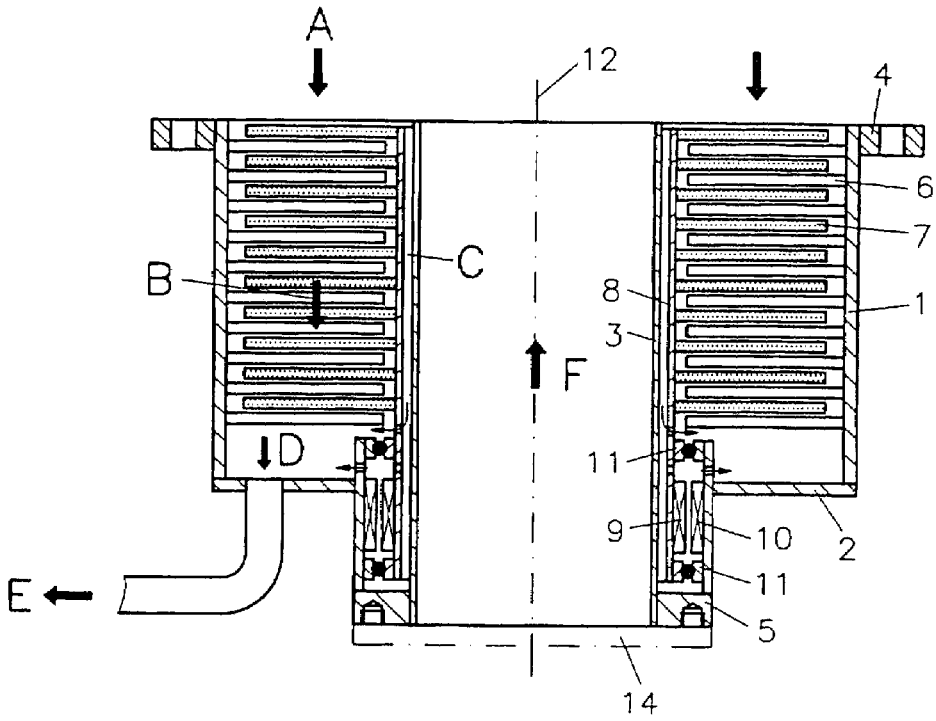
FIG. 1 shows a monitoring-TP, MR-TP.

The single flow passage turbo-molecular pump, the mono-ring-TP which below will be simply designated MR-TP, with a central passage is schematically shown in FIG. 1 in its most simple design. FIG. 1 shows a cross-section in the plane in which the rotor axis is disposed. The MR-TP comprises the following elements which are arranged concentrically with the axis of rotation 12:

The annular induction area A

The compressor chamber B formed by the stator housing 1 and the rotor tube 8 with the alternating arrangement of the stator vane rings 6 and the rotor blade rings 7, The adjacent pre-vacuum chamber D, The drive unit in the pre-vacuum space including the rotor part 9 and the stator part 10 on the stator wall;

The bearing unit 11,

The inner stator tube 3,

The annular gap C formed between the inner stator tube 3 and the surrounding rotor body 8 and, The connector flange 4 on the stator housing at the high vacuum side A, as well as, The flange 5 extending around the open center area F at the ambient front end of the MR-TP.

The wall of the central passage area forms therefore the inner stator tube 3. At the stator base plate 2 of the stator housing 1, the discharge gas guide structure E (discharge tube/s) starts, which extends to the pre-vacuum pump which is not shown in the FIG.

During operation or during emergency operation, the load on the main bearing can be reduced by the installation of an auxiliary bearing between the inner stator tube 3 and the rotor tube 8 for example in the high vacuum end area. The bearings may be mechanical, magnetic or combined magnetic mechanical bearings.

Figure 2:
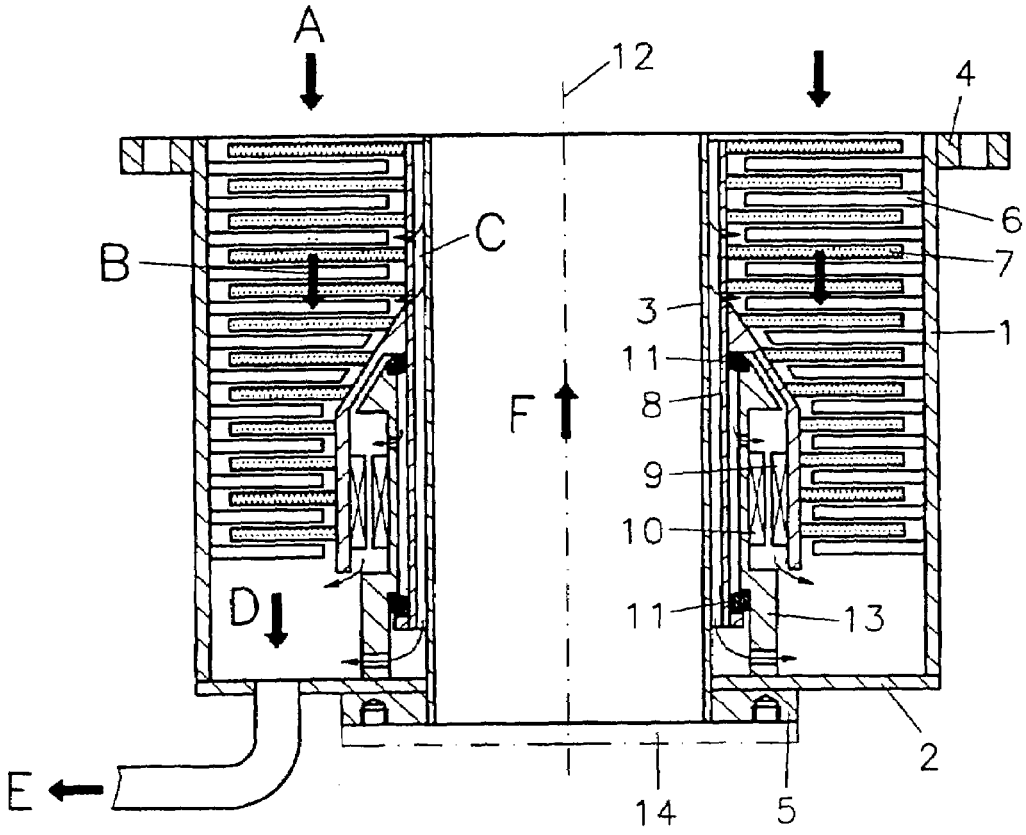
FIG. 2 shows a single flow passage monitoring TP with an annular support bearing structure.

In FIG. 2, the gap C is the same as in FIG. 1, however, the MR-TP differs from that of FIG. 1 by the bearing and drive design. At the lower end of the compressor chamber, the rotor tube 8 consists of a section with wedge-like cross-section. In the pre-vacuum area, an annular support member 13 is supported on the stator base plate 1 and extends into the pre-vacuum area so as to form a concentric bearing support on which the rotor is properly supported as to its center of gravity and moment of inertia. The arrangement of the annular support member 13 is provided with pumping passages so that the gas can be pumped out of the annular gap and the bearing and motor area. In this arrangement, the whole drive unit 9, 10 is also arranged in the pre-vacuum area.

The gap C has in its most simple form smooth walls and a width at which the gas conduction value is below a necessary threshold such that gas backflow out of the pre-vacuum chamber is within tolerable limits. If this cannot be achieved, other measures must be used. Perforations in the rotor tube 8 between the rotor blade rings 7 or in the pre-vacuum area depend on the technical possibilities and the effectiveness of suppressing the backflow or, respectively, the active pumping as well as the structuring at least on the rotating surface of the two surfaces defining the gap therebetween.

In the FIGS. 1 and 2, some perforations are indicated. However, surface structures are not shown as they would render the arrangement vague.

Figure 3:
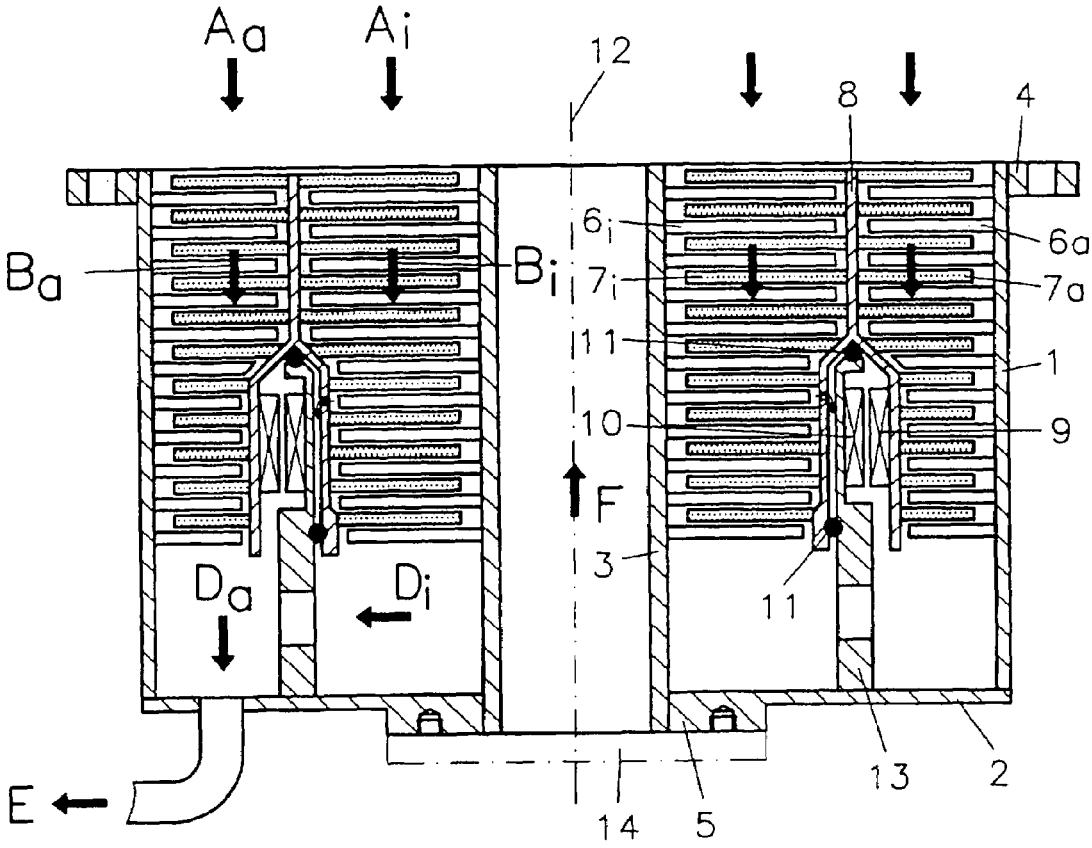
FIG. 3 shows a double-ring-TP, DR-TP

FIG. 3, which shows the duo-ring-TP, which is called shortly DR-TP can be developed from FIG. 2 by increasing the width of the gap C to such an extent that a compressor turbine can be arranged within the gap by way of which gas can be pumped out of the high vacuum area and the pre-vacuum area. The rotor body 8 has a similar structural shape as in FIG. 2. The main bearing and the drive unit are again combined in the annular or conical hollow space of the rotor tube 8. The cross-sectional shape of the annular support member 13 depends on design considerations. In principle, it is only important that there are two concentric similar compression chambers which are like those of FIGS. 1 and 2.

The rotor consists now of a set of outer rotor blade rings 7*a* for the outer compression chamber Ba and a set 7*i* for the inner compression chamber Bi, which was the gap C in the single flow TP. The stator vane rings 6*i* and 6*a*, and the rotor blade rings 7*i* and 7*a* of the one compression chamber extend in radially opposite directions. The stability of the radially inwardly directed rotor blades of a blade ring 7, which, upon rotation of the rotor 8, are not radially aligned toward the center can be achieved by interconnecting the free ends of the inner rotor blade ring 7*i* by a stabilization ring.

The two compression chambers Ba and Bi of the dual ring turbomolecular pump DR-TP are so designed that they have either the same suction power or that it is possible to pump differentially with such a DR-TP design. This depends on the design and the dimensioning of the pump.

The closure plate 14 on the flange 5 is shown in FIGS. 1, 2 and 3 in dashed lines as it is only needed when a separation between high vacuum and ambient is to be established there.

Figure 4:
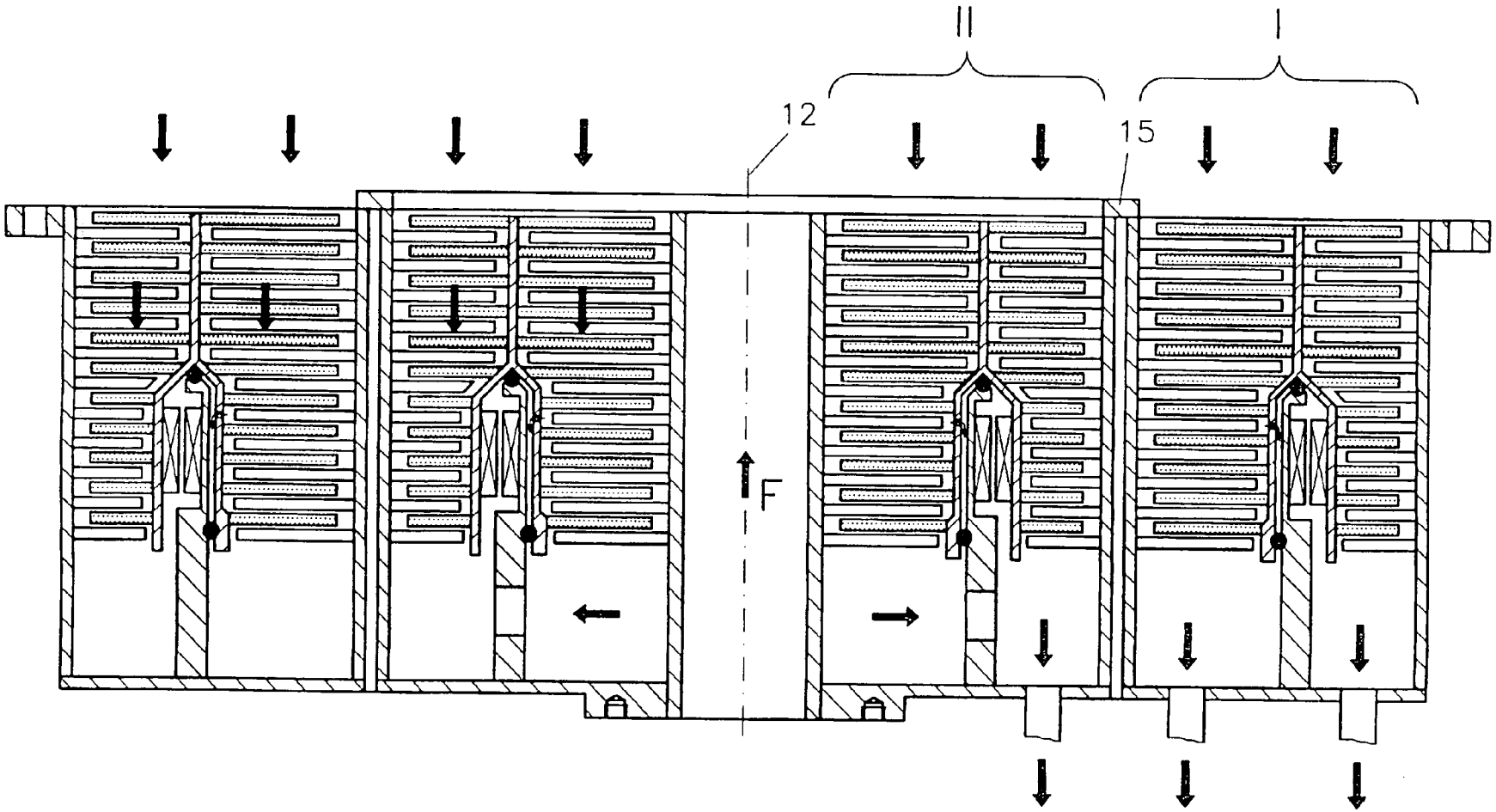
FIG. 4 shows a co-axial turbo-molecular pumping system arrangement.

FIG. 4 shows a modular system of ring turbo-molecular pumps, the system ring-TP in short SR-TP which, in the shown embodiment comprises two DR-TP$_s$.

The two compression chambers Ba and Bi of the dual ring turbomolecular pump DR-TP are so designed that they have either the same suction power or that, with such a DR-TP design, it is possible to pump differentially. This depends on the design and the dimensioning of the pump.

The closure plate 14 on the flange 5 is shown in FIGS. 1, 2 and 3 in dashed lines as it is only needed when a separation between high vacuum and ambient is to be established there.

FIG. 4 shows a modular system of ring turbomolecular pumps, the system ring-TP in short SR-TP which, in the shown embodiment comprises two DR-TP$_n$, DR-TPI, and DR-TP II arranged concentrically within one another. As example, a DR-TP with separate Da and Di and a common vacuum arrangement has been selected. The inner stator tube 3 of the outer DR-TP is connected at the high vacuum side by a ring 15 in a vacuum-tight manner to the corresponding outer stator sleeve of the inner DR-TP. (Integrated systems with a common intermediate wall are of course also possible.) Also systems of modular or integrated systems (SS-TP), of MR-TP$_n$ or mixed system of DR-TP and MR-TP are possible. These space saving SR-TP arrangements increase on one hand, the active suction power at the recipient and, on the other hand, facilitate radially differential pumping.

Figure 5:
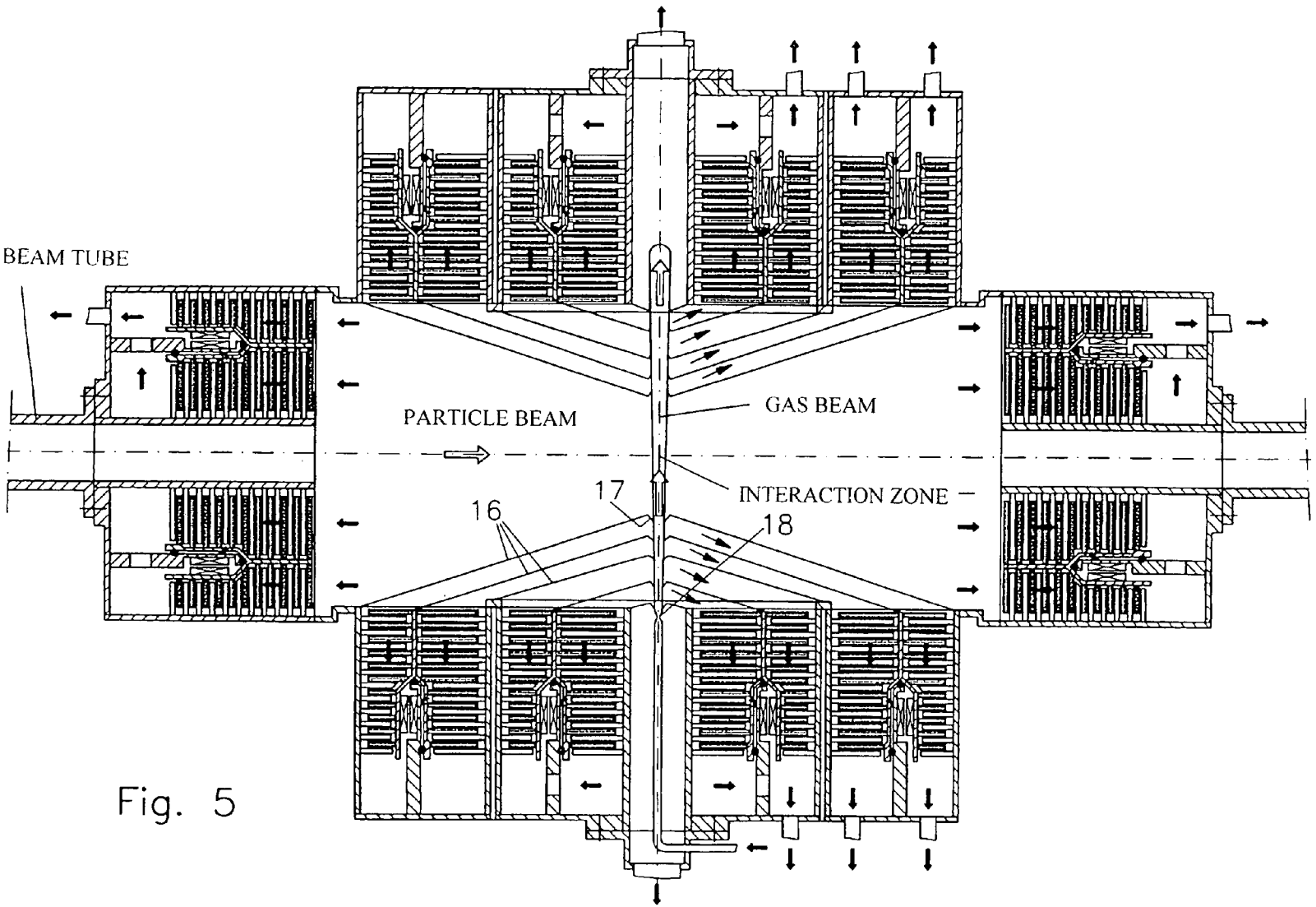
FIG. 5 shows intersecting turbomolecular pump arrangements.

FIG. 5 shows an example of a complex arrangement of PT-groups (SR-TP). It demonstrates the possible variety efficiency and space-saving capability of such an arrangement which is made possible by the presence of the central co-axial open area of each basic ring-TP. It is in this case, the object to maintain the area of intersection between an energetic ion beam crossing a supersonic neutral gas beam (atom beam) at a predetermined high vacuum. Two two-flow passage TP$_n$ (DR-TP) are arranged with their induction areas coaxially opposite each other with a space therebetween. Both pumps are part of the recipient and bridge recipient areas (beam tubes). The common axis is also the axis of the beam of charged particles, for example, an energetic ion beam.

Normal to this pump arrangement of two two-passage TP$_n$(DR-TP), there is provided an arrangement of two four-passage TP$_n$(SR-TP), which are also arranged co-axially opposite each other in spaced relationship with complete suction areas facing each other. Each four passage TP(SR-TP) comprises two two-passage TP$_a$ (DR-TP) that is the smaller DR-TP is disposed in the central open area of the larger DR-TP. The stator housing 1 of the smaller DR-TP is in the high vacuum area connected to the inner stator 3 of the larger DR-TP in a vacuum-tight manner, so that four concentric annular suction surface areas exist for each group. Both four-passage TP groups are provided at their induction faces with funnel-like guide sheets 16 each having a central opening with a skimmer 17. Into the central opening of the one group a tube with a nozzle (Laval nozzle) at its end extends from which a supersonic gas/atom beam is discharged. The slightly divergent supersonic gas beam is peeled off by the skimmers in the center of the gas guide sheets on this TP-group so that in the crossing area with the ion beam, it only has the predetermined beam diameter. The peeled off gas is conducted to the respective annular suction opening and is sucked off by way of the respective turbine/pre-compressor chamber. The central open area is connected to a central pumping stage at the stator base plate and the gas tube for the gas jet nozzle extends to the interior by way of a gas-tight penetration. The gas beam then hits successively, the openings of the opposite TP groups (SR-TP). There, the gas is differentially sucked off from the beam circumference and supplied to the respective intake areas. The remaining gas beam finally reaches the central open area of this group and is there sucked off completely by a central pumping stage provided on the stator base plate. The pump groups of this arrangement pump differentially in multiple ways at least in four passage groups.

All four TP-groups are flanged cross-wise to the central chamber. The two two-passage $TPs_n$ are connected at their respective free centers, that is the central area at the stator base plate, to the recipient that is they connect each two recipient areas of the overall recipient (beam tube of the charged particles).

This vacuum-technical setup is only exemplary for the multiple passages of the respective groups and can be modified as desired. In each case, it provides for short straight gas passages to the respective intake area and consequently provides for large suction effectiveness. The central open area of the basic ring-TP provides for a spatially compact arrangement with extremely high pumping output concentrated to the center, since the individual TP-groups consist of at least one basic ring-TP or of at least two concentric ring-$TP_n$ with co-planar induction areas.

Figure 6:
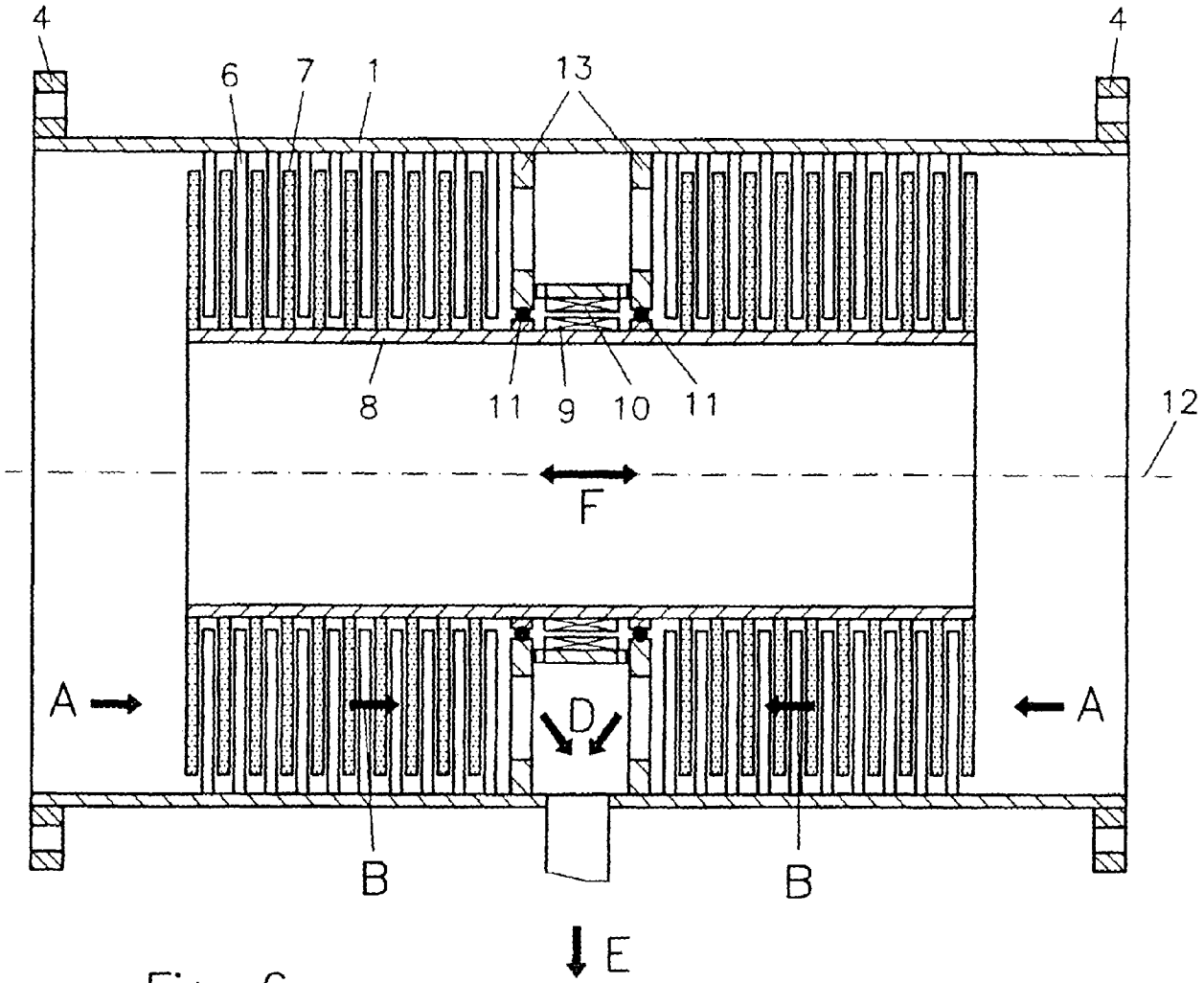
FIG. 6 shows a double-faced tube-TP.

The TP group as shown in FIG. 6, that is, the double-faced tube-TP consists of two basic ring-TPs which have a common axis. Their suction areas are facing in opposite directions. Such a TP-group, a tube-TP, can interconnect only two recipient areas. Based on the structure it consists of the central rotor tube 8, which is concentrically surrounded by the stator housing 1. There is no inner stator tube. On the stator tube 8, two rotor blade sets are disposed. Each rotor tube set 7 starts at a front face of the rotor tube 8. Correspondingly, the two stator vane rings 6 are arranged adjacent the rotor blade sets and together form the compression area B. The compression areas are axially spaced from each other and form the common pre-vacuum chamber D in which the drive unit with the rotor part 9 and the stator part 10 and the bearing 11 are installed. The whole arrangement is mirror-reversed with respect to a plane extending normal to and through the center of the axis of the rotor tube. In the area of the common pre-vacuum chamber, the stator wall 1 includes at least one opening E to which a tube extending to the pre-vacuum pump can be connected. The pre-vacuum chamber may be divided into two halves by the bearing and motor support and each may be separately connected to a pre-vacuum pump. The respective face area of the TP is surrounded by a flange 4 so that in this way two recipient areas can be interconnected.

What is claimed is:

1. In a turbo-molecular pump with a high vacuum-side induction area and of a rotational symmetrical arrangement, comprising:

a compressor turbine including a rotor and a stator tube having axially alternately tightly arranged rotor blade rings and stator vane rings with oppositely oriented blade and vane surfaces, a pre-vacuum space with a gas guide structure for the connection of a pre-pumping system, and a drive module and a bearing unit, the improvement wherein the turbo-molecular pump has a center area with a central coaxial open space extending from an ambient end to the high vacuum-side induction area and the open space is closed at its end adjacent the ambient end thereof by a flange in a vacuum-tight manner or is connected to a vacuum recipient, and the high-vacuum end of this space is separated from the pre-vacuum space.

2. A turbo-molecular pump according to claim 1, wherein the rotor, the drive module and the bearing unit have a central co-axial open area extending from the high vacuum induction area over the pre-vacuum chamber space up to the ambient pressure area and an inner co-axial stator tube extends from the ambient side face area of the stator housing, the base plate of the turbomolecular pump up to the vacuum side front of the rotor and forms the wall of the central co-axial open space.

3. A turbo-molecular pump according to claim 1, wherein the bearing unit and the drive module for the rotor are supported by at least one of an annular support member disposed on a base plate of the turbo-molecular pump and a support member mounted on the central stator tube.

4. A turbo-molecular pump according to claim 3, wherein at least one of said rotor, said bearing unit and said drive module for the rotor is provided with pumping passages which are evenly distributed over the circumference thereof for conducting gas from one end to the other end.

5. A turbo-molecular pump according to claim 1, wherein said rotor is hollow and the stator is a tube and receives the rotor in radially spaced relationship so as to form a co-axial intermediate space and at least one of the walls of the rotor and the stator is structured so as to suppress in the intermediate space a backflow of gas from the pre-vacuum space to the high vacuum space.

6. A turbo-molecular pump according to claim 5, wherein the co-axial intermediate space is reduced at least in sections thereof to a narrow annular gap for limiting a gas back flow.

7. A turbo-molecular pump according to claim 5, wherein at least areas of the co-axial intermediate space are coupled differentially to the existing vacuum conditions at least at the end adjacent the pre-vacuum space and at least at one area in the intermediate area of the compressor turbine by way of pumping channels uniformly distributed over the circumference.

8. A turbo-molecular pump according to claim 5, wherein the hollow cylindrical rotor includes, at least in some areas of the circumference thereof, rotor blade rings and pumping channels are evenly distributed over the circumference in order to pump out the intermediate space axially differentially over the compressor area of the turbine in axial direction thereof.

9. A turbo-molecular pump according to claim 5, wherein at least the rotating wall of the two opposite walls forming the co-axial intermediate space are structured scale-like such that by impulses on the gas particles the particles are moved toward the pre-vacuum side.

10. A turbo-molecular pump according to claim 5, wherein at least some axially opposite areas of the walls of the coaxial intermediate space are provided with helical grooves or projections which are formed on the surface such that, upon operation, the molecules present in the intermediate space are driven preferentially in the direction toward the pre-vacuum space.

11. A turbo-molecular pump according to claim 1, wherein the turbo-molecular pump comprises a double turbine structure in a concentric arrangement with an outer and an inner compression chamber and an outer and an inner annular suction area, wherein the blades of the inner compression chamber extend radially in the direction opposite to that of the blades of the outer compression chamber.

12. A turbo-molecular pump according to claim 11, wherein the ends of the blades projecting radially toward the axis of rotation of each rotor blade ring of the inner compression chamber are joined by a stabilization ring.

13. A turbo-molecular pump according to claim 11, wherein the suction power of the outer turbine and that of the inner turbine are adapted to another.

14. A turbo-molecular pump according to claim 11, wherein the suction power of the inner turbine is different from that of the outer turbine to permit differential pumping.

15. A turbo-molecular pump according to claim 11, wherein the double turbine structure compresses into different chambers and these different chambers are separately evacuated so the differential pumping is possible at different pressures or gas flows.

16. A turbo-molecular pump according to claim 5, wherein a gas guide baffle is tightly connected to the high vacuum end face of at least one of the outer stator tube and the rotor tube and the inner stator tube such that the guide baffle leads to a central passage disposed on the rotor axis.

17. A turbo-molecular pump according to claim 5, wherein the inner high vacuum area adjacent the ambient front end of the inner stator tube is connected to the pre-vacuum space, and, in the inner stator tube adjacent the ambient-end thereof, there is at least one passage to the pre-vacuum space provided with a valve which controls the communication between the pre-vacuum space and the high vacuum area and permits an evacuation of the recipient at high pressure or for safety with faulty pressure values.

18. A turbo-molecular pump arrangement comprising at least two turbomolecular pumps each having a compressor turbine including a rotor and a stator having axially alternately tightly arranged rotor blade rings and stator vane rings with oppositely oriented blade and vane surfaces, a pre-vacuum chamber with a gas guide structure for the connection of a pre-pumping system, a drive module and a bearing unit, including the improvement wherein the turbo-molecular pump has a center area with a central coaxial open space extending from an ambient end to a high vacuum induction area and the open space is closed at its end adjacent the ambient end thereof by a flange in a vacuum-tight manner or is connected to a vacuum recipient, and the high-vacuum end of this space is separated from the pre-vacuum chamber.

19. In a turbo-molecular pump with a rotational symmetrical arrangement including:

an annular intake area, a rotor and a stator forming a compressor turbine having axially alternately arranged closely adjacent rotor blade rings and stator vane rings a pre-vacuum chamber with a gas guide structure for connection to a pre-vacuum pump system, a drive module and a bearing unit, the improvement wherein the stator extends around the rotor over the full length thereof and the rotor has a central opening extending co-axially over its full length, the rotor is provided at both ends thereof with rotor blade rings mounted axially adjacent one another onto the rotor and the stator is provided with stator vane rings extending inwardly between the rotor blade rings and forming compression chambers with a pre-vacuum chamber arranged axially between the compression chambers, the rotor-stator arrangement has opposite end faces forming opposite annular intake areas to the gas guide structure, the drive module is disposed between the two compressor chambers in the pre-vacuum chamber, and the bearing unit is integrated into the drive unit or arranged directly adjacent thereto.

20. A turbo-molecular pump according to claim 19, wherein the inner wall around the opening of the rotor is coated with a material which is so formed that stray energetic particular photon rays which do not follow a path through the center of the opening are at least partially absorbed on this interior wall and the heat generated thereby is removed from the pre-vacuum area by a cooling arrangement.

* * * * *